US006068101A

United States Patent [19]

Dickenson et al.

[11] Patent Number: 6,068,101

[45] **Date of Patent: *May 30, 2000**

[54] GAMING MACHINE CURRENCY APPARATUS AND METHOD THEREFORE

[75] Inventors: Robert M. Dickenson, Henderson; Richard Jay Schneider, Las Vegas; Joseph Wesley Cole, Las Vegas; Linn A. McKay, Las Vegas, all of Nev.

[73] Assignee: Casino Data Systems, Las Vegas, Nev.

[ * ] Notice: Under 35 U.S.C. 154(b), the term of this patent shall be extended for 73 days.

[21] Appl. No.: 08/729,602

[22] Filed: Oct. 11, 1996

[51] Int. Cl.[7] ..... G07F 7/04; G07F 17/34

[52] U.S. Cl. ..... 194/206; 463/25

[58] Field of Search ..... 194/206, 207, 194/350; 232/15, 16; 273/138.2; 463/16, 25

[56] References Cited

U.S. PATENT DOCUMENTS

| | | | |
|---|---|---|---|
| 3,397,763 | 8/1968 | Wahlberg | 194/206 |
| 4,636,951 | 1/1987 | Harlick | 463/25 |
| 5,113,990 | 5/1992 | Gabrius et al. . | |
| 5,544,728 | 8/1996 | Dabrowski | 194/206 |
| 5,635,696 | 6/1997 | Dabrowski | 194/206 X |
| 5,676,231 | 10/1997 | Legras et al. | 194/206 |

FOREIGN PATENT DOCUMENTS

| | | | |
|---|---|---|---|
| 3727927 | 3/1989 | Germany | 194/350 |

*Primary Examiner*—F. J. Bartuska
*Attorney, Agent, or Firm*—Bernhard Kreten

[57] ABSTRACT

A gaming machine and method including a housing having a door which exposes a currency mechanism along a medial portion thereof and located between a side wall and a monitor. This strategic location of the currency mechanism allows clearance for an underlying coin hopper so as to minimize the need for an external currency mechanism and to provide access to the coin hopper in a much more maintenance friendly manner for tending to the coin hopper and currency mechanisms, e.g. for filling, etc.

26 Claims, 9 Drawing Sheets

GAMING MACHINE CURRENCY APPARATUS AND METHOD THEREFORE

FIELD OF THE INVENTION

The following invention relates to gaming machines in general and in particular to machines for which currency can be admitted into the gaming machine to enable a player to use the machine.

BACKGROUND OF THE INVENTION

Gaming machines have evolved from devices which only receive coins as the enablement for play to devices where either coins or currency can be used. One problem in utilization of a currency apparatus involves locating it strategically on the machine, not only for ease of use, but also for ease of maintenance and especially for currency transfers to and from the machine.

Certain clearance problems exist in retrofitting existing machines with a currency receiving instrument. One problem involves accommodating traditional gaming components such as monitors typically used in video-type gaming machines and coin mechanisms. Coin mechanisms have coin receiving slots leading to a chute, hopper and to a storage and dispensing area. A currency mechanism must clear these components and allow easy access.

The following prior art reflects the state of the art of which applicant is aware and is included herewith to discharge applicant's acknowledged duty to disclose relevant prior art. It is stipulated, however, that this reference does not teach singly nor render obvious when considered in any conceivable combination the nexus of the instant invention as disclosed in greater detail hereinafter and as particularly claimed.

| U.S. Pat. No. | ISSUE DATE | INVENTOR |
|---|---|---|
| 5,113,990 | May 19, 1992 | Gabrius, et al. |

The patent to Gabrius, et al. teaches the use of an externally mounted bill validator and change system for a slot machine. This device is distinguishable from the instant invention in that, inter alia, it is not internally mounted.

SUMMARY OF THE INVENTION

The instant invention accommodates the clearance and engineering problems delineated hereinabove by providing a monitor disposed in substantially the same horizontal plane as the currency mechanism such that the currency mechanism is adjacent one side wall of a housing of the gaming device and abuts against the monitor support area. The currency mechanism is deployed substantially amidships with respect to a long axis of the machine so that an area directly below the monitor and currency mechanism can receive the coin mechanism. A coin slot is located in front of a lower portion of the currency mechanism and receives a coin which diverts the coin through a chute to a storage hopper. The hopper communicates with a tray so that a player winning on the gaming machine can receive money back from the dispensing tray.

The currency mechanism is supported on a trackway which allows the mechanism to be accessed from its stored position within the housing and be moved to an outwardly extending position for service.

The currency mechanism may preferably be the type which not only receives bills, but which also sorts them as to denomination and then dispenses them upon a payout. Thus, a machine so equipped can go for greater periods of time between "fills" when an attendant is required to replenish funds within the machine. This reflects several advantages because a lesser amount of money is required to reside in the machine when it is initially "stocked" because the player's money is being recirculated.

OBJECTS OF THE INVENTION

Accordingly, it is an object of the present invention to provide a new and novel gaming machine.

A further object of the present invention is to provide a device as characterized above which is extremely durable and reliable in use.

A further object of the present invention is to provide a device as characterized above requires less maintenance.

A further object of the present invention is to provide a device as characterized above in which the currency mechanism is strategically located thereby providing clearance for other components.

Viewed from a first vantage point it is an object of the present invention to provide a gaming machine comprising, in combination: a housing including a top portion, a middle portion and a bottom portion, the middle portion including a front wall having two side portions and means for supporting a currency means along one side portion thereof and exposed on the front wall.

Viewed from a second vantage point it is an object of the present invention to provide a method for reducing fills in a gaming machine comprising: receiving currency to enable a game, sensing the currency both as to denomination and acceptability, returning unacceptable currency, storing acceptable currency by denomination, dispensing the currency correlative with an award based on a pay table.

Viewed from a third vantage point it is an object of the present invention to provide a gaming machine comprising, in combination: a currency means medially disposed and adjacent one side of a housing, the currency means exposed on a front wall of the housing, and slide means coupled to the currency means to allow the currency means to be moved from a stored position to an exposed position, allowing access to the currency means.

These and other objects will be made manifest when considering the following detailed specification when taken in conjunction with the appended drawing figures.

DESCRIPTION OF PREFERRED EMBODIMENTS

Figure 1:
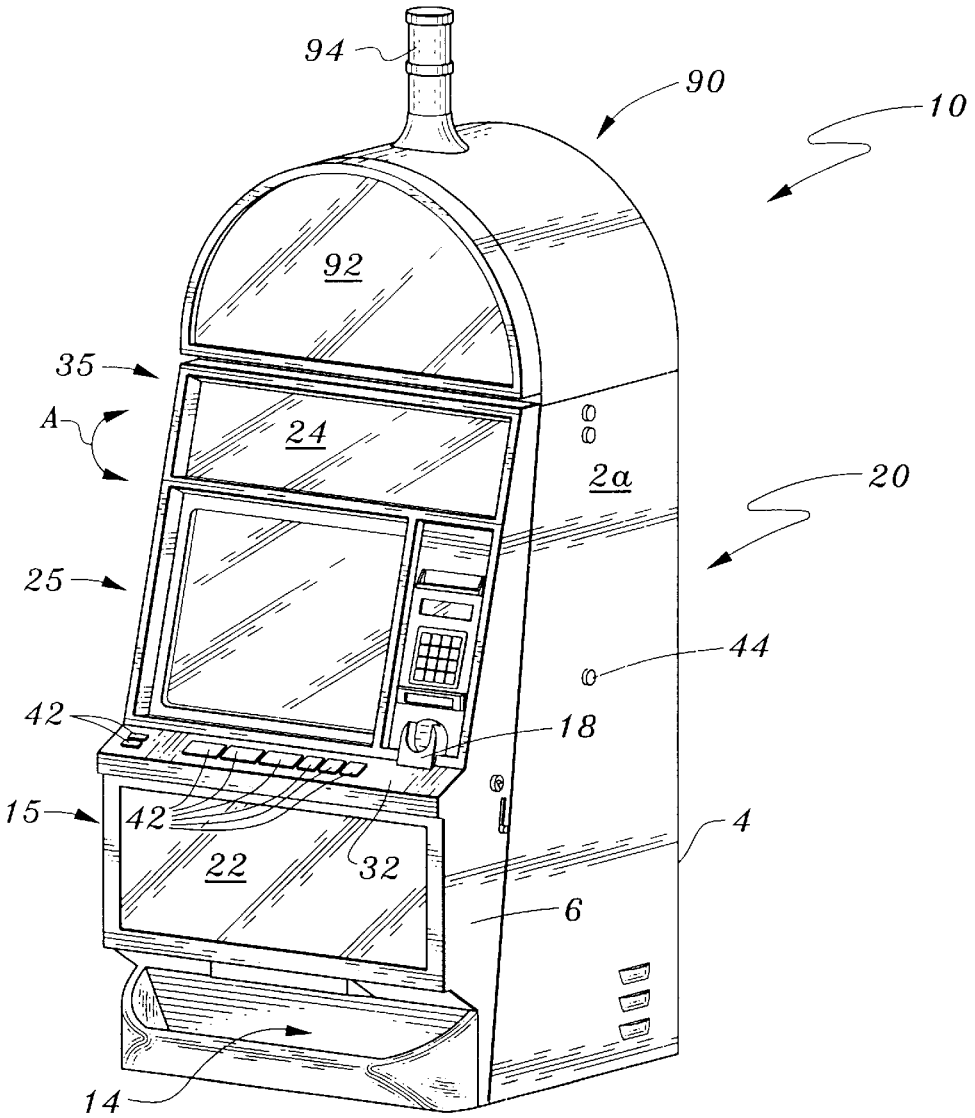
FIG. 1 is a perspective view of the gaming machine apparatus according to the present invention.

Referring to the drawings, wherein like reference numerals denote like parts throughout the various drawing figures, reference numeral 10 is directed to the gaming machine according to the present invention.

Figure 4:
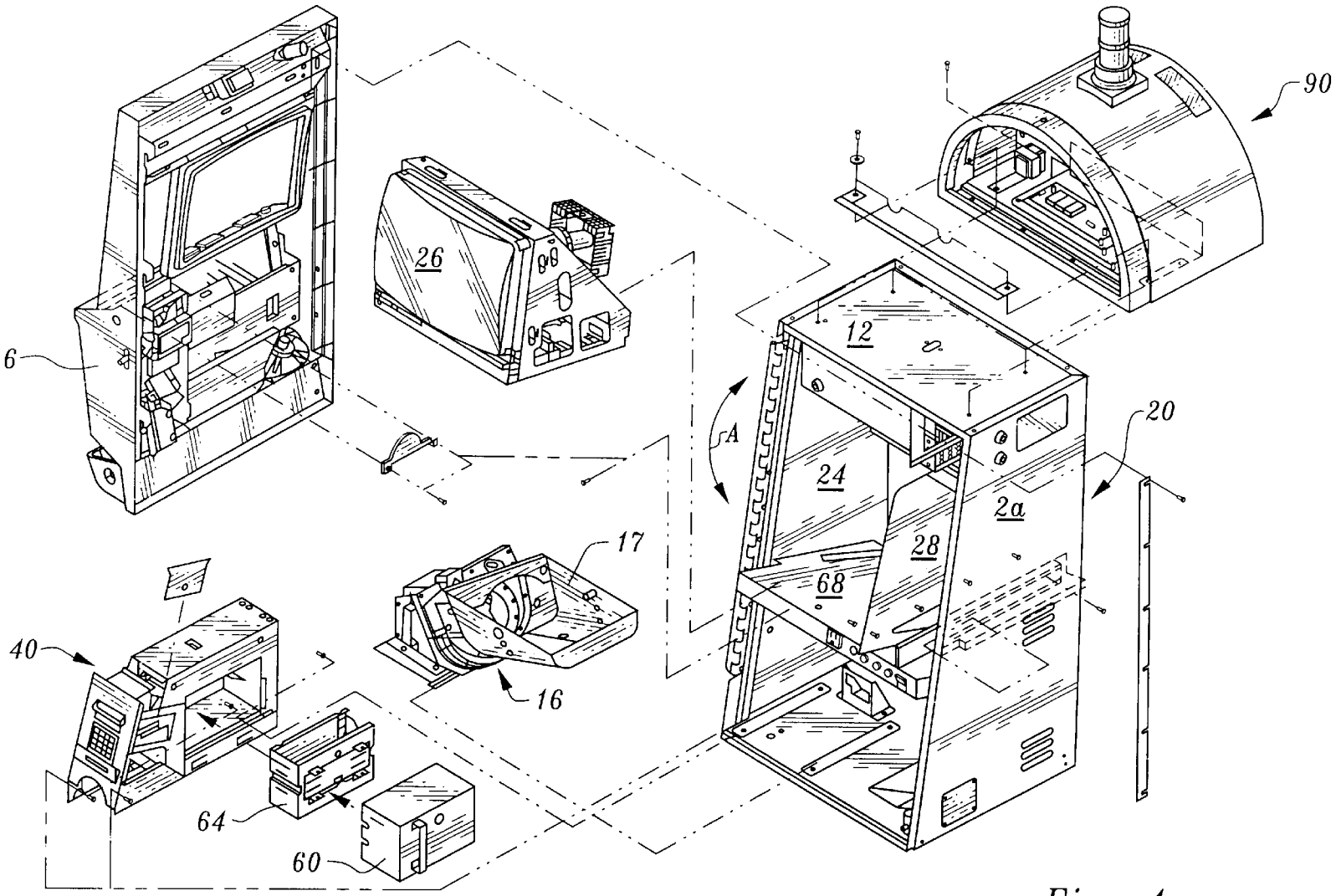
FIG. 4 is an exploded parts view of the cabinet housing and certain of its components according to the present invention.

In its essence, and viewing FIG. 4, the gaming machine 10 preferably includes a round top assembly 90 has a flat bottom which is fastened onto a flat roof 12 of an underlying housing 20. The round top 90 appears as a semi-cylinder, includes a semi-circular front display 92 and includes a beacon 94 at its highest point located in a plane of vertical symmetry. The housing 20 has spaced parallel side walls 2 and a back wall 4. A door 6 defining a front wall is hinged 8 to one of the side walls and moves from an open position (FIG. 4) to a closed position (FIG. 1) about arrow "A". The open door 6 allows access to the interior and various mechanisms.

For example, the housing includes a bottom portion 15, a lowermost area of which has an underlying return tray 14 for the return of coins. Inside the machine 10, FIG. 4, and immediately upward from the return tray, a coin mechanism 16 is located. The coin mechanism 16 includes a hopper 17 to receive coins from a coin slot 18 located at a middle portion 25 of the machine 10. The coin hopper 17 not only receives the coins, but orients them in an operative position for subsequent dispensing via the return tray 14 should an award be due a player for having played the machine and earned an award based on a pay table generally located on belly glass 22 at the bottom portion 15, overlying the coin hopper 17 on the housing door 6. Sometimes the pay table can be located on an upper portion 35 of the machine 10 via a display glass 24.

Between the upper portion 35 and the bottom portion 15 is the middle portion 25. This middle portion 25 includes a monitor 26 for a video game apparatus. The monitor 26 is offset from a central vertical plane of the machine and is adjacent one side 2, in this case a side nearest the hinge 8. A space between the opposite side wall 2*a* and a partition 28 near the monitor 26 defines a channel for receipt therein of a currency mechanism 40. Access to the currency mechanism is preferably gained by either opening the door (FIG. 4) or by sliding out the currency mechanism 40 through the door (FIG. 2).

In use, either a coin or a bill is inserted and decisions are made based on that which appears on the monitor. By manipulating a plurality of buttons 42 located on door 6 just below the monitor and on a shelf 32, the game is played. Should an award be due, the award can be dispensed via either the return tray 14 and/or via the currency mechanism 40.

Figure 2:
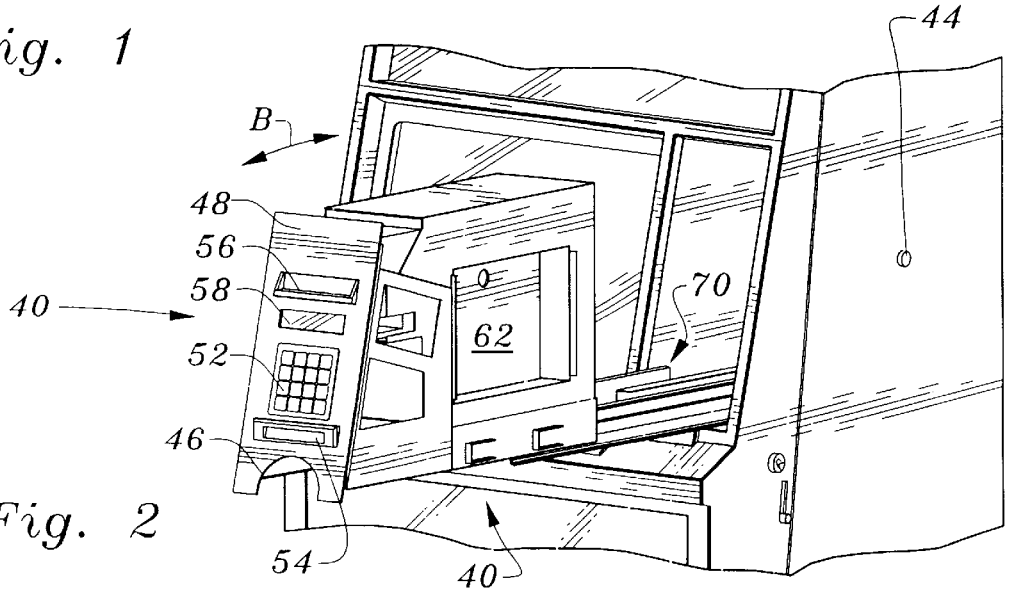
FIG. 2 details the currency mechanism in perspective according to one form of the present invention.
Figure 3:
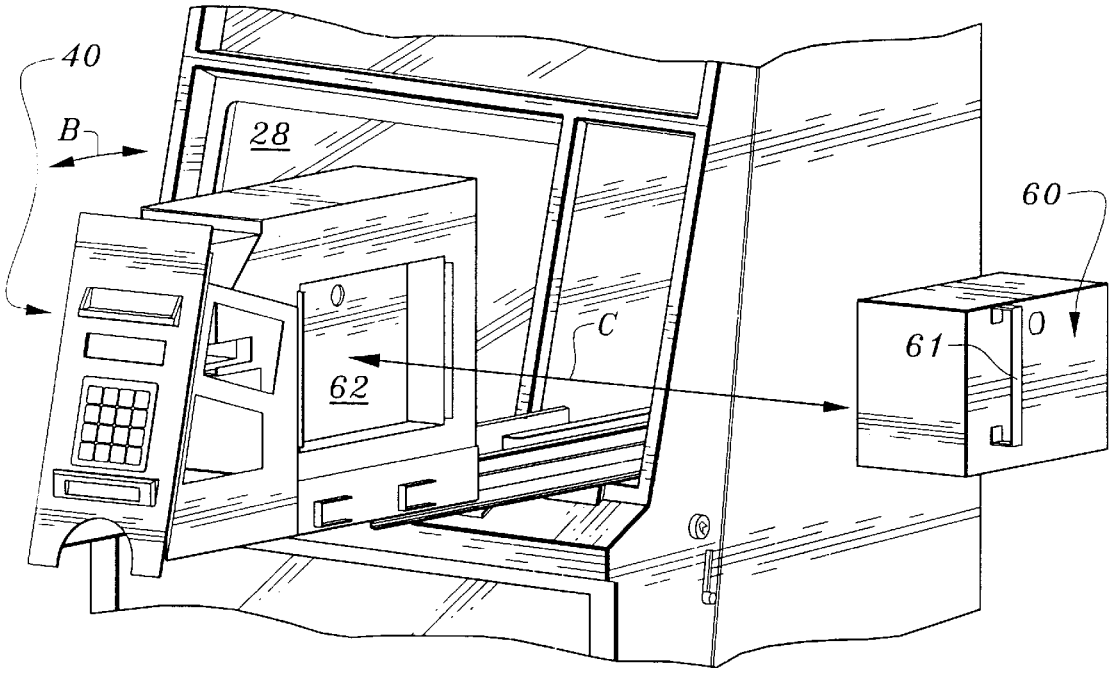
FIG. 3 details the currency mechanism with a bill safe showing its placement into the currency mechanism.

More particularly and with reference to FIGS. 1 through 9, details of the currency mechanism and its ability to move between a first stored deployed position (FIG. 1) and a second accessible position (FIG. 2) can be explored. An opening 44 on wall 2*a* provides access to a key slot which allows the currency mechanism 40 freedom to move from a first position to a second position. The first position shown in FIG. 1 depicts the currency mechanism 40 stored within the housing of the gaming machine 10. FIG. 2 shows the currency mechanism 40 free to be accessed by an attendant without having the door 6 of the gaming machine 10 opened by the attendant.

This important feature allows the remainder of the game to reside in a secure atmosphere free from the risk of access by unauthorized third parties who could tamper with the manner in which the game operates. It should be noted that in a gaming environment, when a door 6 of a gaming machine 10 is open it can send a signal to a control area indicating its "down" status and access to an interior of the machine. Typically, in order to preserve the integrity of the gaming apparatus, access to the interior of the machine must be supervised and witnessed by various people. By allowing the currency mechanism 40 to be accessed without the door being opened, the integrity of the gaming apparatus itself is assured and the degree of intrusion is kept to a minimum. Typically, access to the currency mechanism 40 is to remove accumulated bills. Other situations may call for removal of a "paper" jam.

In any event, access to the currency mechanism 40 is achieved via the lock 44. The currency mechanism 40 shown in FIG. 2 includes an arcuate, medially disposed cutaway 46 on a bottom edge of a front panel 48. The cutaway 46 allows clearance for the coin slot 18 to pass thereunder when the currency mechanism 40 is moved along the double ended arrow "B" thereby gaining access to the currency mechanism exterior of the gaming machine 10 while the door 6 remains secure and closed. The currency mechanism 40 may include a touch pad 52 for transmitting information such as credit information in conjunction with a card reader 54. For example, the card reader 54 is located on a front face of the currency mechanism 40 and is operatively in communication with a "controller" that monitors the status of transactions vis-a-vis the gaming machine and a central accounting area remote from the gaming site. In other words, the touch pad in combination with the card reader can allow credits from a card to be displayed and utilized on the gaming apparatus 10. In addition, a slot 56 for the through passage of currency is provided. Finally, the front panel 48 can include an LED window 58 that can provide an electronic message to the user of the gaming device.

FIG. 2 shows the currency mechanism 40 with a bill slide unit 60 already removed from a cavity 62 of the currency mechanism. The bill slide unit 60 (FIG. 4) stores the currency and in FIG. 2 is exposed for access away from the machine via a trackway 70. As shown in FIG. 4, the slide 60 also includes a nesting tray 64 within which a plurality of bank notes can be stacked and held secure within the slide 60. Typical maintenance for a machine having a currency mechanism 40 involves removing currency. The slide 60 moves along the double ended arrow "C" of FIG. 3 by "U" shaped handle 61 fixed to an exposed surface of slide 60 in order to be received within and removed from the currency mechanism 40.

Figure 7:
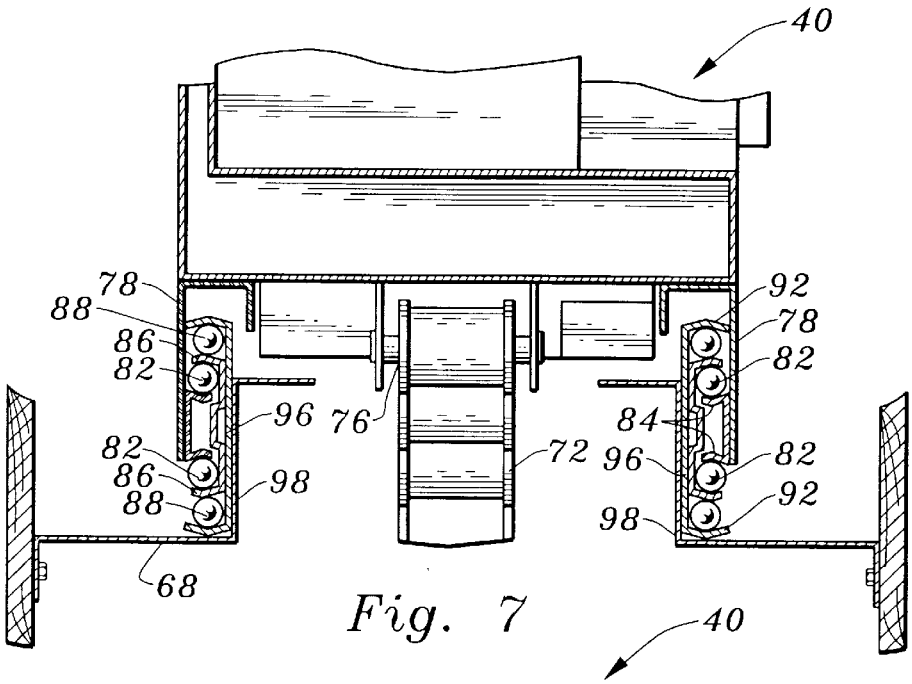
FIG. 7 is a sectional view taken along lines 7—7 of FIG. 6.
Figure 8:
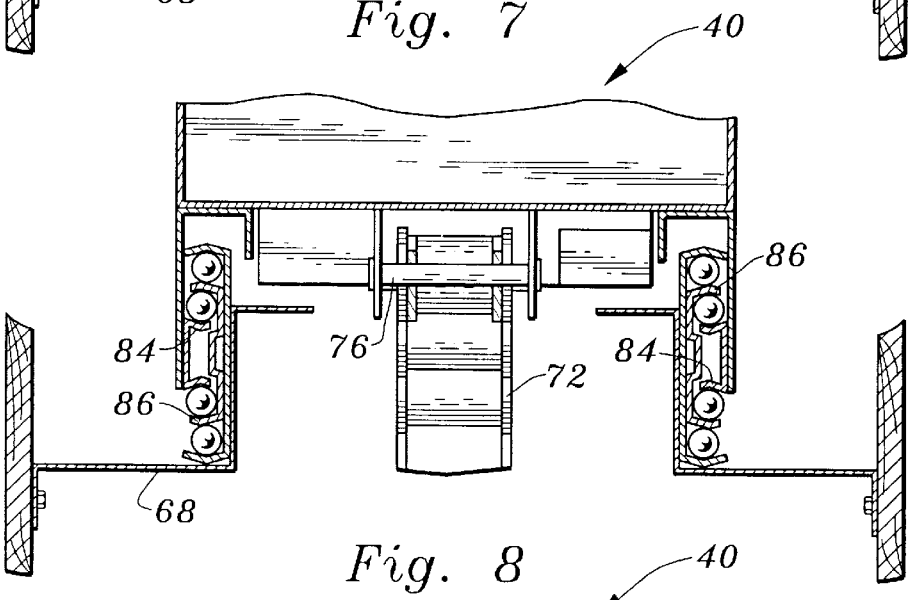
FIG. 8 is a sectional view taken along lines 8—8 of FIG. 6.
Figure 9:
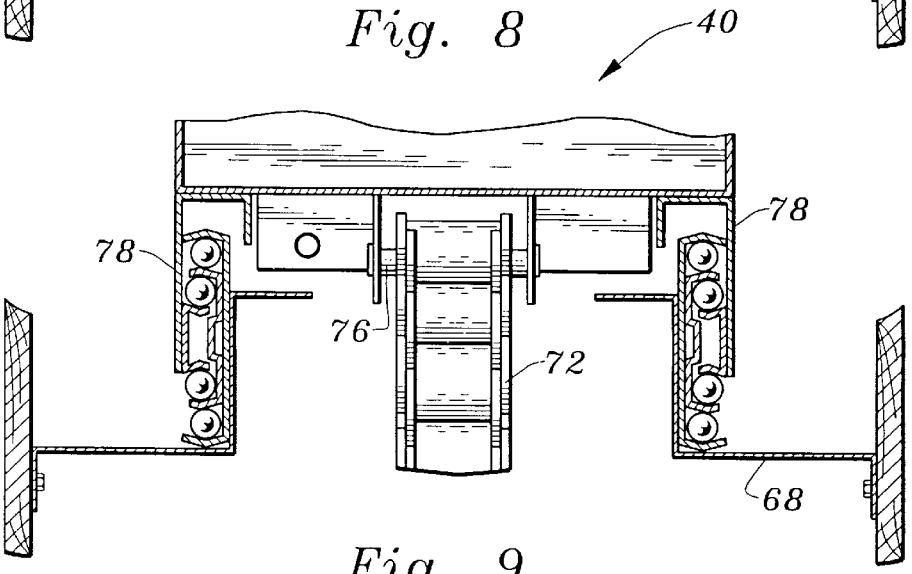
FIG. 9 is a sectional view taken along lines 9—9 of FIG. 6.
Figure 11:
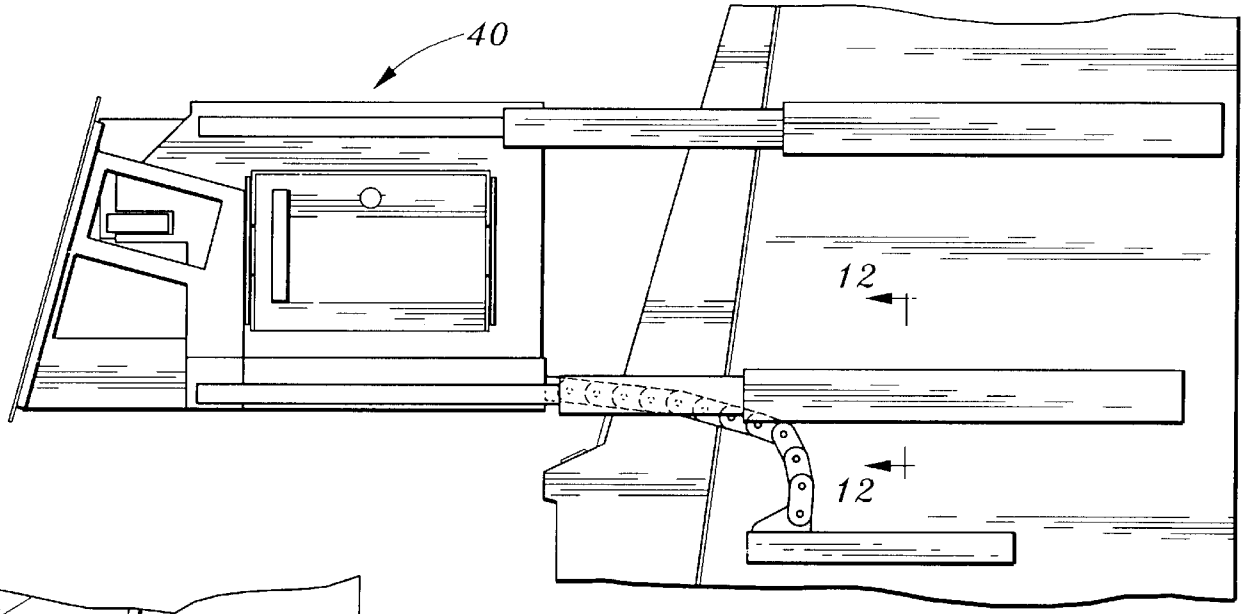
FIG. 11 is a view similar to FIG. 6, a side view of the alternative embodiment of FIG. 10.
Figure 10:
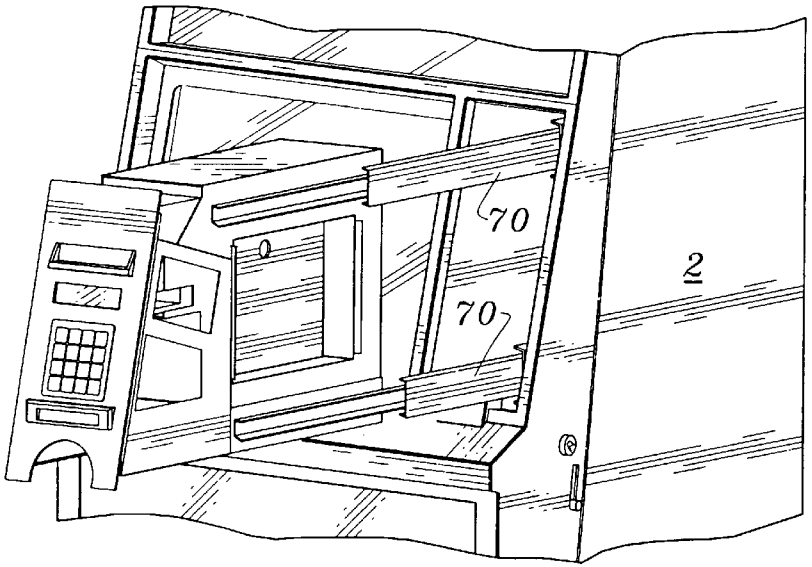
FIG. 10 is a view similar to FIG. 3 showing a different support mechanism, being on the side rather than the bottom.
Figure 12:
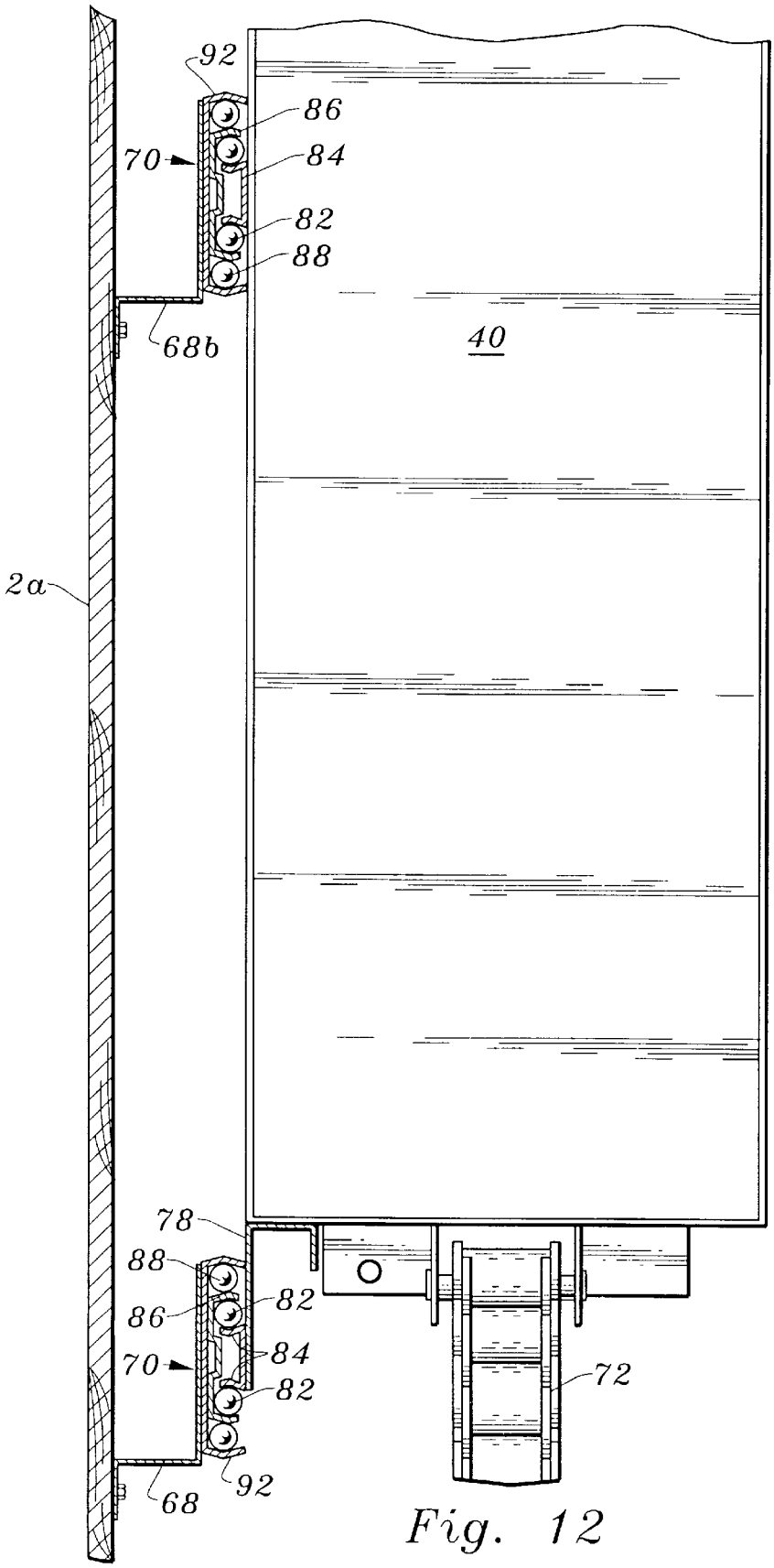
FIG. 12 is a sectional view taken along lines 12—12 of FIG. 11.

The currency mechanism 40 is spaced from the monitor 26 by means of partition 28. The monitor 26 and the currency mechanism 40 can be supported on a shelf 68 as shown in FIGS. 4 and 7 through 9. As shown in FIGS. 7 through 9, the shelf 68 has a central interrupted portion underlying the currency mechanism 40 to allow clearance for currency mechanism's trackway 70 for moving along the direction of the double ended arrow "B" of FIG. 2. Alternatively, rather than mounting on shelf 68, the currency mechanism 40 can use a trackway 70 supported on the side wall 2*a* as is shown in FIGS. 10 through 12 and will be discussed infra.

Figure 5:
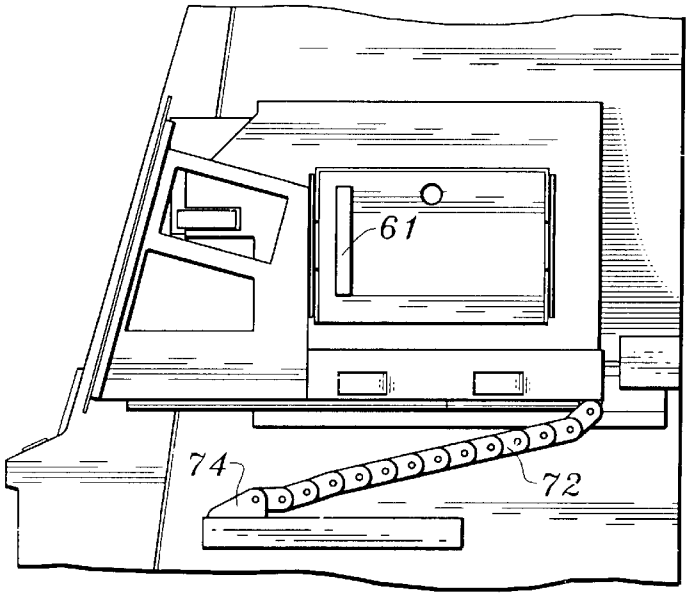
FIG. 5 is a side view of the currency mechanism in a stored, nested position within the housing.
Figure 6:
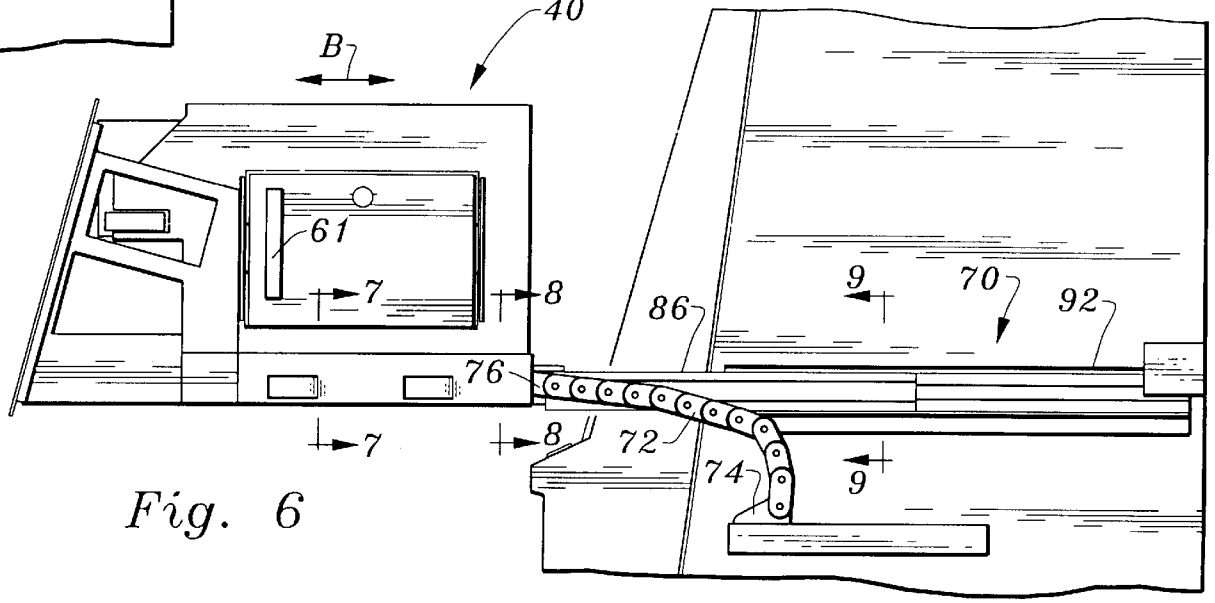
FIG. 6 is a similar view to FIG. 5, with the currency mechanism extended and outside the housing, exposed.

As shown in FIGS. 5 and 6, one version of the currency mechanism 40 moving from the FIG. 5 to the FIG. 6 position along arrow "B" utilizes a trackway 70 that rests on shelf 68 and allows the currency mechanism 40 to extend out of the housing. The trackway 70 telescopes from the top of the shelf 68. In addition, the extent to which the currency mechanism 40 can move is limited by means of a chain like tether 72 having one end attached to an interior cleat 74 of the housing and another end 76 attached to the currency mechanism 40. The trackway 70, also shown in FIGS. 7 through 9 includes first and second downwardly extending legs 78 emanating from the currency mechanism 40. The legs 78 communicate with a central set of linearly oriented, upper and lower ball bearings 82 captured between a linear inner race 84 and a linear central race 86. In turn, the central linear races 86 communicate with a further set of upper and lower outer ball bearings 88 constrained by upper and lower outer linear races 92. These upper and lower races 92 include an interconnected vertical wall 96 that attaches to upstanding projections 98 of the shelf 68. This allows the currency mechanism 40 to telescope along the direction of the arrow B in stages.

As shown in FIG. 6, the outermost race 92 is shown within the interior of the cabinet as it is attached to the projections 98, and the central race 86 includes a portion which projects out. The innermost race 84 is fixed to stay within the interior of the currency mechanism 40. This structure provides support for the currency mechanism 40 when extended.

The currency mechanism 40 is strategically located along a medial portion 25 of the gaming device 10. Moreover, the currency mechanism 40 is laterally offset with respect to a vertical plane of symmetry of the gaming device 10. This location allows accommodation of many of the other components traditionally found in a gaming device. Particularly, the monitor 26 must be located at a comfortable area for the player, at eye level, and therefore its location is mandated by the ergonomics of the environment. Similarly, the currency mechanism 40 is equally as accommodating in this structure. The coin-in slot 18 also benefits from this ergonomic location. Both the currency mechanism and the coin-in slot 18 are removed from the viewing area of the monitor 26 to provide an unobscured view of the monitor 26 during play. Decision making buttons 42, located on shelf 32, are also strategically located directly below the screen for ease of use. By having the hopper 17 for the coin mechanism 16 offset the coin receiving slot 18, but still overlie the tray 14, one of the ongoing persistent problems of locating these components has been resolved. By locating the coin mechanism 16 in the lower portion 15 of the gaming apparatus 10, a larger inventory of coins can be stored. This increased storage obviates the necessity for more frequent fills as has been the custom.

FIGS. 10 through 12 reflect a second version of a support mechanism for allowing the currency mechanism 40 to move along the direction of the arrow "B" from a stored position within the housing to an extended position for maintenance. Areas of similarity with FIGS. 5 through 9 will not be belabored here so as to not obscure the invention. In this version, instead of having the trackways 70 located on opposite sides of the currency mechanism, the trackways 70 are vertically stacked, one above the other and preferably attached to an inside surface of wall 2*a*. Thus, there is need for only one lower shelf 68 and a counterpart 68*b* is located up inside of the side wall 2*a* (FIGS. 10 through 12). Partition 28 could also have been used to support the currency mechanism 40. In either event, the currency mechanism 40 still includes one downwardly extending projection 78 which as before accommodates the inner linear race 84 and ball bearings 82. Middle linear race 86 captures an outer set of ball bearings 88 that communicate with outer linear race 92. The vertical partition 28 or wall 2*a* directly supports the currency mechanism 40 via inner race 84 through a Z-shaped leg 68*b* and bearings 82, 88 and races 86, 92 to move in the direction of the double ended arrow "B". As before, a tether 72 is employed to limit motion.

The foregoing discussed geometry allows sufficient clearance that the currency mechanism 40 described can be of the type that only receives bills. It may also be one which both receives and dispenses bills. This is due in part to the space saving from the relationship of having the currency mechanism 40 located in a medial portion of the gaming device 10 and laterally offset from a vertical plane of symmetry. One type of bill receiver and dispenser is made by a Japanese company and distributed by JCM of 3940 E. Craig Road, Suite 101, North Las Vegas, Nev. 89031 as model HBP-10.

Figure 13:
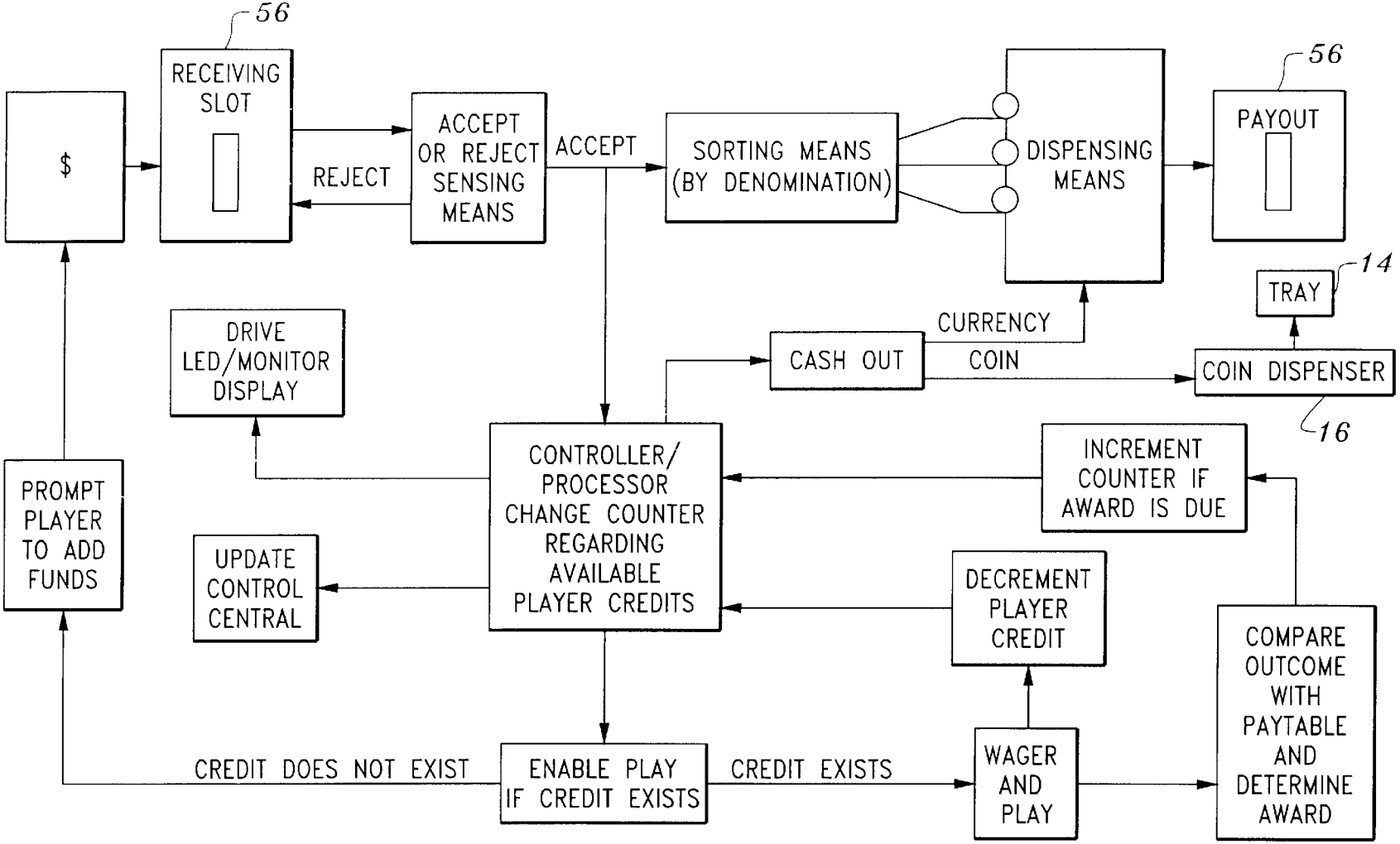
FIG. 13 is a schematic of a currency mechanism that both receives and dispenses currency.

In FIG. 13, currency is received via the receiving slot 56 of FIG. 2. After the receiving slot, the currency is exposed to a sensing means which either accepts or rejects it based on the appearance of the bill and is a bill validator. A rejected bill is returned back to the player via receiving slot 56. An accepted bill is sorted as to denomination and then stored in a dispensing means for subsequent use.

Once the bill has been accepted, the player will have been apprised of the increase in credits available to the player, and such information can commonly appear on the monitor 26 for the player's convenient viewing. In order to update the monitor, a controller is informed of the receipt and acceptance of the currency. The controller can also monitor this activity at a remote location (not shown) and use this information as a diagnostic for other purposes, such as user tracking, machine maintenance, etc. Once it has been determined that credits are available for play, the player can enable the machine to make a wager and play. In the alternative, should there be a shortage of funds, a prompt can be placed to the player either via the LED read out 58 or on the monitor 26 or both. Once the player has wagered, the player's credit has been decremented an appropriate amount and that information is received in the counter and to the controller. After the game has concluded, the outcome of the game is compared with a pay table by the machine and an award is determined. If the outcome of the game warrants an increment of the counter, the counter is changed and the controller is informed. The player then can continue to play if credit exists or can cash out, in which event the dispensing means will return money via the slot 56.

In some instances, both the dispensing means and the coin return hopper will act in concert to discharge to the player with the remaining credits on the machine. Assume for example that the machine plays in increments of twenty-five cents and the player has a balance of five dollars and twenty-five cents on the machine. In such a case, the dispensing means would distribute either five one dollar bills or a five dollar bill and the coin hopper would dispense a quarter.

Heretofore, without a bill dispenser on the machine, the coin hopper would be subjected to this demand totally in coins requiring more frequent hopper fills and greater hopper capacity. By receiving and dispensing some of the currency back to the user, games can go for greater periods of time without intervention by an attendant. As importantly, the gaming establishment is not required to keep as large an amount of money in the machines to satisfy the needs of the customer. For example, if only currency is taken into the machine and not dispensed to the player, a relatively large amount of coins are required in the hopper, providing space problems in order to satisfy the needs of the player. By providing a means for dispensing currency as well as receiving currency, a much smaller amount of money is required to stock the machine for regular use.

Figure 15:
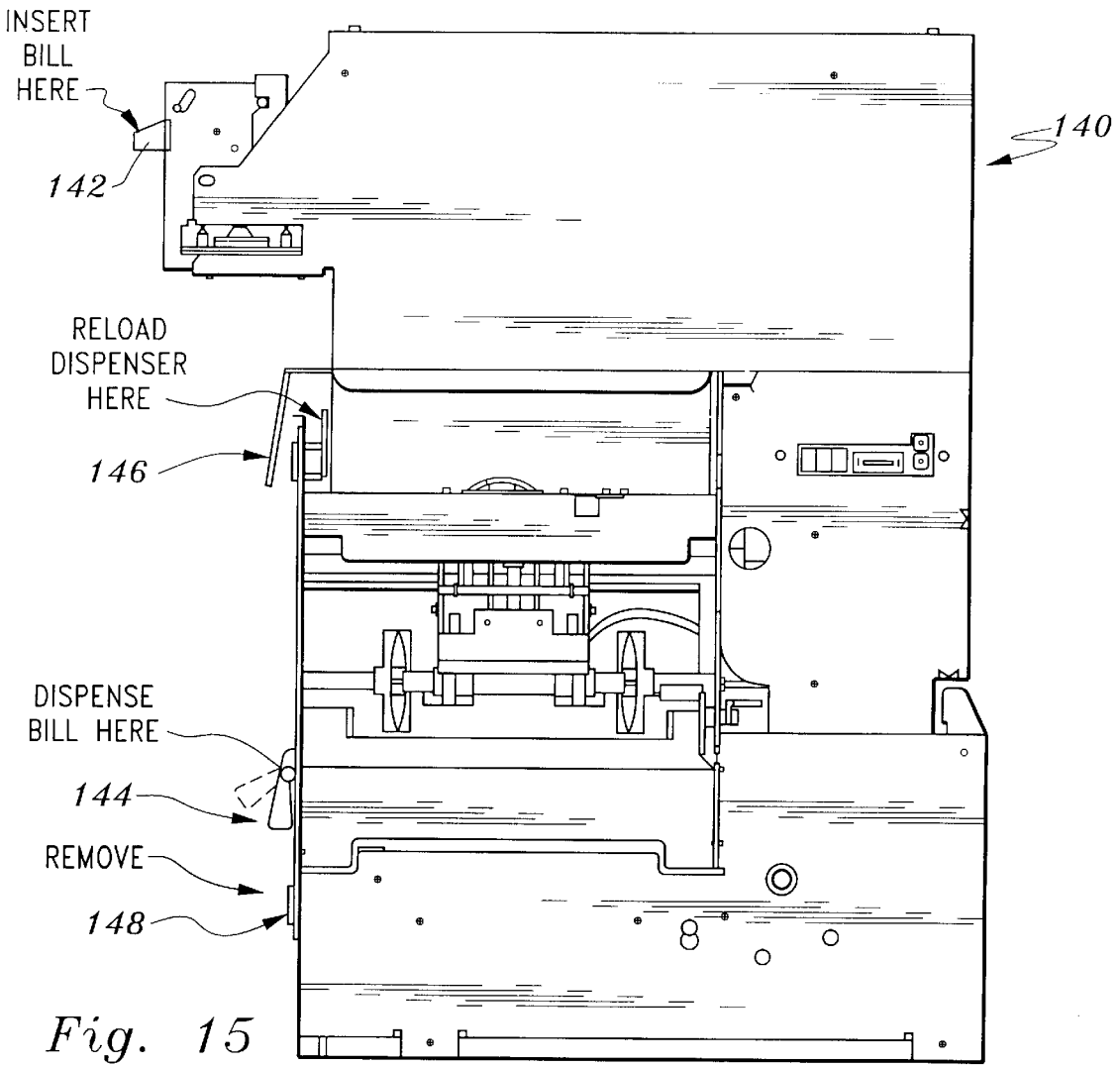
FIG. 15 is a side view of FIG. 14.
Figure 14:
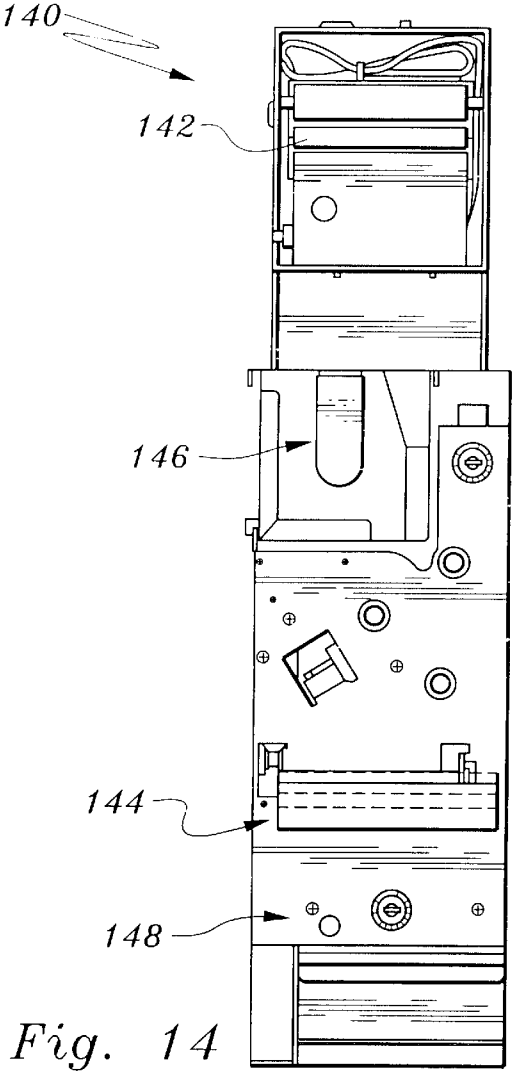
FIG. 14 is a front view of a currency receiver and dispenser.

FIGS. 14 and 15 show a combined bill receiver/validator and dispenser 140. Bills are inserted at inlet 142. Bills are paid out at outlet 144. If the bills are not recirculated (as in FIG. 13), and those to be dispensed are of a single denomination, the bill dispenser 140 is used and is replenished via reservoir ingress 146. In dispensing, should two or more bills be stuck together (or other anomalies be sensed) they are stored in bin 148 rather than dispensed via outlet 144.

Moreover, having thus described the invention, it should be apparent that numerous structural modifications and adaptations may be resorted to without departing from the scope and fair meaning of the instant invention as set forth hereinabove and as described hereinbelow by the claims.

What is claimed is:

1. A gaming machine comprising, in combination:

a housing including a top portion, a middle portion and a bottom portion, said middle portion including a front wall having two side portions and means for supporting a currency means along one side portion thereof and exposed on said front wall and means for supporting a display means along the other side portion thereof for displaying a game;

means for playing the game based on decisions made on that which appears on said display means;

means for comparing an outcome of the game with a paytable and determining an award;

said currency means including means for dispensing bills correlative to any applicable award based on the outcome of the game.

2. The machine of claim 1 wherein said bill dispensing means includes means to dispense bills upon condition of a player cashing out credits.

3. The machine of claim 2 wherein said bills are of a single denomination.

4. The machine of a claim 3 including means operatively coupling said currency means and a coin means whereby said currency means and said coin means operate in concert to dispense bills and coins.

5. The machine of claim 4 wherein said currency means includes a currency bin for receiving bills not to be dispensed due to anomalies sensed by said bill dispenser.

6. The machine of claim 5 including means for circulating currency from a bill receiver to said bill dispenser.

7. The machine of claim 1 wherein said currency means includes currency receiving means and means for sorting currency received from said currency receiving means as to denomination.

8. The machine of claim 7 wherein said bill dispensing means dispenses currency in the form of bills based on credits accumulated during play.

9. The machine of claim 8 including means for synchronizing a coin mechanism with said bill dispenser for dispensing both coin and bills correlative to a winning award.

10. The machine of claim 9 including a lock securing said currency means to said housing which when unlocked allows said currency means to move from a first stored position within said housing to a second exposed position free to be accessed while precluding internal access to a remainder of the game for preserving the integrity of game operation.

11. The machine of claim 10 including an access portal passing through said front wall allowing said currency means to advance therebeyond.

12. The machine of claim 11 wherein said front wall is provided with means for opening said front wall thereby defining a door, and said door capable of pivoting open by means of a hinge.

13. The machine of claim 12 wherein said currency means is supported on trackway for linear translation.

14. The machine of claim 13 wherein said trackway is mounted on a shelf.

15. The machine of claim 14 wherein said currency means includes an LED display for communicating with a player.

16. The machine of claim 15 including means for updating the amount of credit available to a player and displaying said available credit on said display means accessible to the player.

17. The machine of claim 16 including means for communicating the machine credit status to a central control.

18. The machine of claim 17 including a personal identification card means accessible to said currency means for transferring credit to and from said machine.

19. A method for reducing fills in a gaming machine comprising:

receiving currency to enable a game, sensing the currency both as to denomination and acceptability, returning unacceptable currency, storing acceptable currency by denomination, dispensing the currency in the form of both bills and coins correlative with an award based on a pay table.

20. A gaming machine comprising, in combination:

a bill receiver/dispenser means medially disposed and in adjacent one side of a housing, said bill receiver/dispenser means exposed on a front wall of said housing, and slide means coupled to said bill receiver/dispenser means to allow said bill receiver/dispenser means to be moved from a stored position to an exposed position, allowing access to said bill receiver/dispenser means while precluding internal access to gaming electronics by unauthorized personal who could tamper with the manner in which the game operates.

21. A gaming machine comprising, in combination:

a housing;

a bill receiver/dispenser means operatively disposed within said housing and exposed on a front wall of said housing;

said bill receiver/dispenser means including means for dispensing bills upon condition of a player cashing out credits.

22. The gaming machine of claim 21 further including a coin receiver/dispenser means including means for dispensing coins in concert with said means for dispensing bills upon condition of the player cashing out credits.

23. The gaming machine of claim 22 wherein said bill receiver/dispenser is slideable mounted within said housing for allowing said bill receiver/dispenser to be moved from a stored position to an exposed position while retaining a remainder of game operations to reside in a secure atmosphere free from risk of access by unauthorized parties who could tamper with the manner in which the game operates.

24. The gaming machine of claim 22 further including a video monitor operatively disposed within said housing and exposed on said front wall for displaying a game.

25. The gaming machine of claim 24 further including means for playing the game based on decisions made on that which appears on said display means and further including means for comparing an outcome of the game with a paytable and awarding credits to the player correlative to any applicable award based on said comparison.

26. The machine of claim 22 including a personal identification card means accessible to said bill receiver/dispenser means for transferring credit to and from said machine.

* * * * *